US005648811A

United States Patent [19]

Thiel et al.

[11] Patent Number: 5,648,811

[45] Date of Patent: Jul. 15, 1997

[54] POSTAGE METER

[75] Inventors: Wolfgang Thiel; Stephan Günther; Wolfgang von Inten; Heinz Rehberg; Wolfgang Muhl, all of Berlin; Dieter Wölm, Gross Schulzendorf, all of Germany

[73] Assignee: Francotyp-Postalia Aktiengesellschaft & Co., Birkenwerder, Germany

[21] Appl. No.: 108,987

[22] Filed: Aug. 18, 1993

[30] Foreign Application Priority Data

Aug. 28, 1992 [DE] Germany ..... 42 28 765.0
Aug. 11, 1993 [EP] European Pat. Off. ..... 93112895

[51] Int. Cl.[6] ..... B41J 11/14; B41J 11/20

[52] U.S. Cl. ..... 347/220

[58] Field of Search ..... 347/220, 171

[56] References Cited

U.S. PATENT DOCUMENTS

| | | | |
|---|---|---|---|
| 4,358,103 | 11/1982 | Koike et al. | 271/248 |
| 4,420,269 | 12/1983 | Ackermann et al. . | |
| 4,461,212 | 7/1984 | Gerney | 101/407 R |
| 4,553,861 | 11/1985 | Lendl . | |
| 4,626,873 | 12/1986 | Kotani et al. . | |
| 4,763,575 | 8/1988 | Miciukiewicz . | |
| 5,212,499 | 5/1993 | Hongo et al. | 347/220 |

FOREIGN PATENT DOCUMENTS

| | | |
|---|---|---|
| 0145404 | 6/1985 | European Pat. Off. . |
| 0195981 | 10/1986 | European Pat. Off. . |
| 0298774 | 1/1989 | European Pat. Off. . |
| 2519583 | 7/1983 | France . |
| 3417381 | 11/1985 | Germany . |
| 3935348 | 5/1991 | Germany . |

*Primary Examiner*—Huan H. Tran
*Attorney, Agent, or Firm*—McCormick, Paulding & Huber

[57] ABSTRACT

The invention concerns a postage meter with an electrothermal printing device by means of which value indications and/or graphics are printed onto a postage item moved past it at a predetermined speed by the transfer of color particles in a graphic forming distribution from a carrier web (114), which carrier web is heated by means of a thermal print head in correspondence to the graphic forming distribution and is driven past the printing device, with a counterpressure element (116) standing oppositely to the thermal print head (110). As the counterpressure element a counterpressure roll (116) is provided which is movable in a direction perpendicular to the printing surface, which counterpressure roll is so yieldingly supported on a shaft arranged parallel to the printing ledge (112) of the thermal print head (110) that its contact face with the postage item can take on different angles to the printing ledge (112) in a plane containing the printing ledge (112) and the shaft (130).

24 Claims, 8 Drawing Sheets

POSTAGE METER

Figure 1:
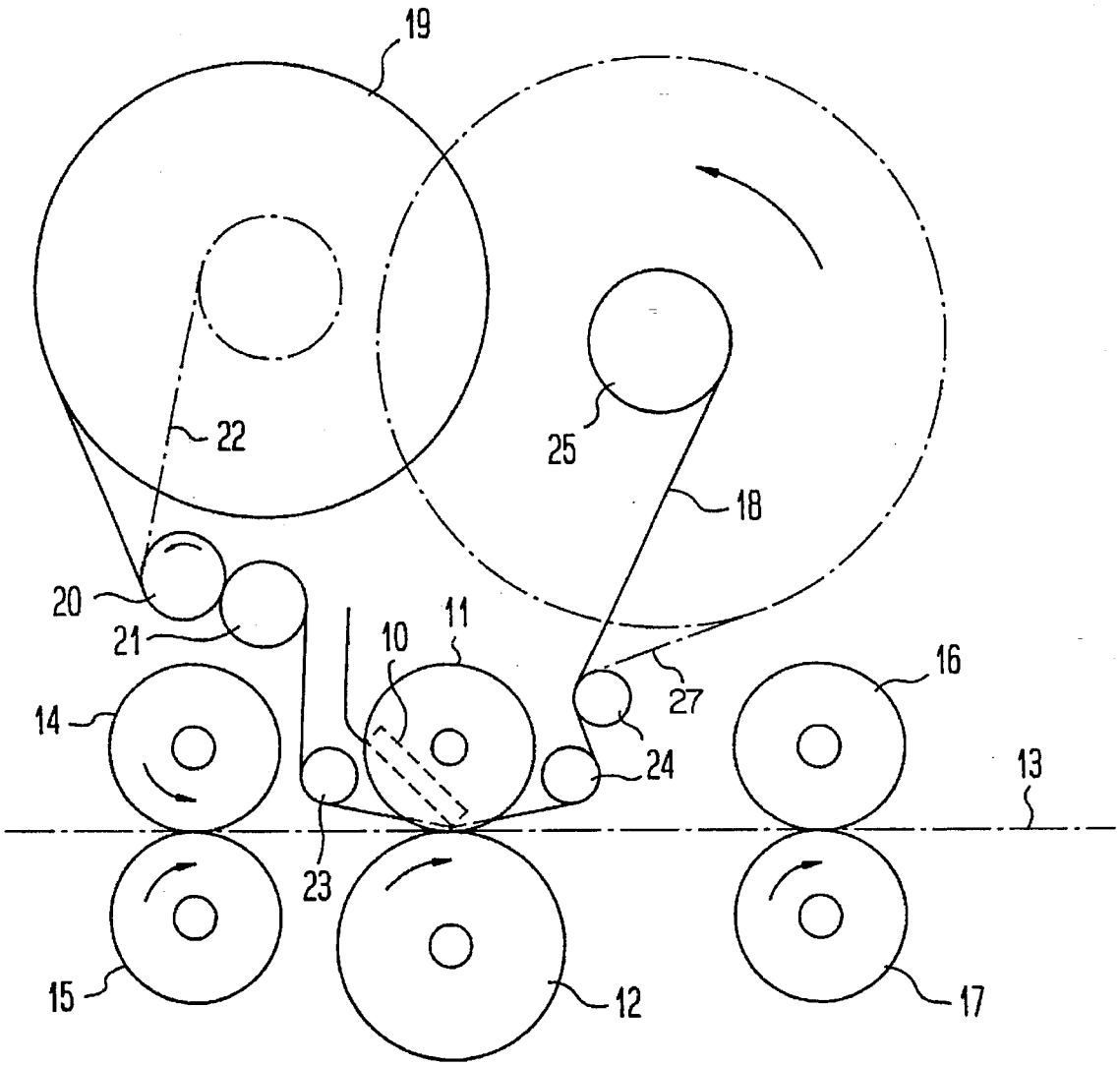

The invention concerns a postage meter with an electrothermal printing device by means of which value indications and/or graphics are printed onto a postage item moved past it at a predetermined speed by the transfer in a graphic forming distribution of color particles from a carrier web, which carrier web is heated in correspondence to the graphic forming distribution by means of a thermal print head and is moved past the printing device, with a counterpressure element standing opposite to the thermal print head.

A printing device for a label printer is known for example from DE 39 35 348 A1. It works with a thermal print head whose forward surface is formed as the printing surface and in which a straight row of selectively electrically heatable transfer pins are arranged. These have the effect, when they are heated and the carrier web is moved past them, that the color particles provided on the web are melted out of their binding medium and can transfer to the item to be printed if the item to be printed moves with the carrier web past the thermal print head. In order that in this method a predetermined pressure is maintained between the print head and the item to be printed, the counterpressure element is formed as a counterpressure roll biased by spring force in the direction toward the print head, which counterpressure roll can selectively be brought to an operating position or to a rest position.

If this principal is used in a postage meter, the working speed is limited by the time required for the selective heating of the individual transfer pins of the thermal print head as well as for their cooling. There has indeed been developed certain control procedures for the thermal print head whereby a certain speeding up of the printing process is possible, yet connected with this is a complication especially in the required control circuit which leads to an increased cost for the postage meter.

Also, an electrothermal printing device is already known from DE 21 00 611 C3 in which the moved carrier web has a definite electrical resistance (so called ETR-web), wherein a layer of electrical resistance material can be provided as the carrier for the color particles. The thermal print head has no electrically heatable transfer pins, but instead has a row of printing electrodes or micro-contacts, which upon the moving therepast of the carrier web stand in connection with the resistance material, and with selective control a current flow through these contacts can be created to a collecting electrode, so that the web is selectively heated to melt out the color particles from the web and to effect their transfer to the item to be printed.

Since here no transfer pins are heated and cooled on the print head, a higher printing speed is possible which in the case of a postage meter also makes possible a higher operating speed. This was known previously but not realized. The postage item has in contrast to a normal sheet shaped graphic carrier, because of bending, folding or irregular contents, a generally variable shape over its length and a non-uniform printing surface. If it is moved through the printing region of a printing device working with a current flow through the carrier web, the print head can not lie with the carrier web on the non-uniform upper surface, for example of an envelope, without producing a fault containing contact between its print electrodes and the carrier web. This expresses itself in the appearance of the printed graphic; and moreover damage to the printing ledge of the thermal print head can appear because of spark erosion. Also if the thermal print head is pressed with large spring force onto the carrier web and the postage item, or if the counterpressure element creates an elastic pressing of the thermal print head to the postage item, in order to achieve a certain compensation of the non-uniformities, new problems are created, for a pressing of a thermal print head with a force of more than about 10 grams per print electrode leads to an unacceptably high wear of the electrode faces and to a substantial shortening of the useful life of the thermal print head.

Moreover, a postage meter is known from EP 0 298 774 A2 whose thermal print head has heating elements selectively heated in accordance with the graphic to be printed in order to convey printing particles from the carrier web to the envelope. A counterpressure roll is stationarily arranged opposite to the thermal print head, which counterpressure roll cooperates with pressure rolls. The pressure rolls are arranged on both sides of the thermal print head. If the surface to be printed is uneven because of bends, folds, etc., it can happen that the entire surface is not impinged by printing particles of the carrier web. The printed graphic therefore contains empty spaces or blurs.

A printing head holder is known from U.S. Pat. No. 4,626,873 which presses. a thermal print head against a print carrier which lies on a counterpressure roll. The print holder is pivotally supported in elongated holes, so that the print head can within limits execute reciprocating movements relative to the counterpressure roll in addition to pivotal movements.

Further, a printer with a thermal print head is known from U.S. Pat. No. 4,553,861 which can carry out pivotal movements relative to a counterpressure plate under spring pressure. The pivotal movements are produced by an electromagnet with relatively large reciprocation. In a rest position, in which it does not print, the print head pivots with actuation of the electromagnet rearwardly and moves out of engagement with a thermal transfer web. In the operating position the electromagnet is so actuated that the print head lies on the thermal transfer web and transfers color to a print carrier.

Moreover, in the state of the art (DE 34 17 381 A1) it is known to use a device for suiting a needle print head to the thickness of a paper to be printed, which device senses the thickness of the paper by means of a sensing roll. The deflecting movement of the feeler roll is conveyed to a holder for the print head, which moves it therewith relative to a stationarily arranged printing countersupport.

A postage meter is known from U.S. Pat. No. 4,924,240 with a printing apparatus using a stationarily arranged thermal print head. A counterpressure element standing opposite to the thermal print head is so arranged that it can be moved toward and away from the thermal print head. The counterpressure element during printing is elastically pressed against the thermal print head and against guide rolls.

The object of the invention is to provide a postage meter equipped with an electrothermal printing apparatus which makes it possible to also print with high quality on uneven surfaces of postage items.

This object is solved in that as the counterpressure element a counterpressure roll movable in a direction perpendicular to the printing surface is provided, which counterpressure roll is so yieldingly supported on a shaft arranged parallel to the printing ledge of the thermal print head that its contact surface with the postage item can take on different angles to the printing ledge in a plane containing the printing ledge and the shaft.

In accordance with the invention the contact surface of the counterpressure roll can tilt relative to the printing ledge of the thermal print head. Thereby the printing force can be uniformily distributed over the contact surface and a constant printing pressure can be created along the length of the printing ledge. The printing elements of the thermal print head can therefore conduct energy in uniform distribution to the carrier web so that its color is likewise uniformily transferred to the postage item.

If for example an envelope contains a coin, in accordance with the state of the art it would indeed be expected that a postage item spoilage would appear in that the counterpressure roll carries out a deflecting movement in a direction perpendicular to the transport direction of the envelope. The pressure produced by the counterpressure roll against the thermal ledge of the thermal print head is however only high in the region of the coin, so that an irregular color printing is achieved. Since a reduced force is conducted to other locations of the envelope there exists therefore the danger that at the location of the coin a concentrated force will be produced on the thermal print head which is too large and which will wear or otherwise damage the print head. In the case of the invention the contact surface nestles by adjustment to different angles to the printing surface of the thermal print head to the coin and outside of the area of the coin likewise exerts a pressure. Thereby the printing ledge of the thermal print head always remains in contact with a large portion of the upper surface of the envelope so that a trouble free color printing results.

The invention can also be used for the ETR-method (electro-thermal-resistive-method), in which the carrier web has a resistance layer heated by printing elements formed as electrodes of an ETR-print head in correspondence to a pre-given graphic. At the heated spots of the carrier web the color is transferred to the postage item. In the ETR method relatively high printing forces are required in order to obtain a uniform graphic. The subject of the invention satisfies the high demands of the ETR-method.

The invention can be used with a stationarily arranged thermal print head as well as with a moveable one. In the case of a stationary thermal print head the guide for the carrier web can also be stationarily arranged. Thereby the construction expense for the web guide elements is lowered and the movement of the carrier web is stabilized.

In a preferred embodiment of the invention the counterpressure roll is non-rotatably connected at its ends with its shaft through a bellows. Such a bellows allows the contact surface of the counterpressure roll to so press on the postage item that the contact surface can take different angles relative to the printing surface in the transport direction. Thereby the counterpressure roll nestles better with the uneven spots of the postage item so that the pressure along the length of the printing ledge is still uniformily distributed.

Further development is characterized in that the counterpressure roll is supported on a fork connected with a holding element preferably through a rotary joint whose axis of rotation is at least nearly perpendicular to the longitudinal axis of the shaft of the counterpressure roll and at least nearly parallel to the transport direction of the postage item. By means of this measure the counterpressure roll can execute additional pivoting. movements about the rotational axis of the joint so that even in the case of relatively large objects, enclosed within the postage item and which produce uneven upper surfaces, the contact surface of the counterpressure roll can execute a large angular movement without the pressure distribution of the contact surface becoming non-uniform.

The above mentioned embodiments can be so further developed that the fork has at least two rolls which support the counterpressure roll on the side thereof facing away from the thermal print head at angularly spaced locations from one another about the circumference of the roll. The jacket surface of the counterpressure roll during rotation bears upon the rolls. They thereby reduce the bearing force working on the shaft.

In an advantageous form of the invention the counterpressure roll is adjustable along an axis running perpendicularly to the transport direction of the transported item by an adjusting apparatus. The adjusting apparatus has two drive positions: in one of which the counterpressure roll presses the postage item by spring pressure against the printing surface of the thermal print head; and in the other of which the counterpressure roll takes on a rest position in which the thermal print head is removed. By this measure the thermal print head is impinged with a force from the counterpressure roll only upon the transport of the postage item.

Further, the above mentioned holding element can include an elastic part, for example a helical spring. This part urges the fork forwardly in the direction perpendicular to the printing surface. When the longitudinal axis of the shaft is arranged stationarily and the jacket surface of the counterpressure roll is supported by rolls the spring force effects an eccentric displacement of the counterpressure roll in the direction of the printing ledge through a bellows. Therefore thickness variations of the postage items, for example in the area of 0 to 3 mm, can be compensated.

A preferred embodiment of the invention involves a pre-adjustment device which pre-adjusts the counterpressure roll to a spacing relative to the printing surface of the thermal print head which is dependent on the thickness of the postage item. The reciprocating movement of the counterpressure roll for carrying out the printing process, and which is still required, is then limited to a relatively small path, for example 3 mm, independent. of how thick the postage item to be printed is. The apparatus for adjusting the printing roll can thereby be optimized to a relatively short reciprocating movement.

A further development of the aforementioned embodiment provides that the postage item on the transport path to the thermal print head is sensed as to thickness by a sensor, which sensor provides a signal to a control for the driving motor of the pre-adjusting device, if a pre-given thickness is exceeded. The pre-given thickness can for example be 3 mm. Therefore, an automatic adjusting movement is not automatically carried out for each postage item, but only when the pre-given thickness value is exceeded. Since thereby the number of positioning movements of the pre-adjusting device is limited the postage meter can in general work quickly and reliably.

A further solution of the above mentioned object in the case of a postage meter of the previously mentioned kind exists in that the counterpressure element is arranged stationarily, that pressure elements are arranged on both sides of the thermal print head, that the transport nips formed by the pressure elements with the counterpressure elements include the printing ledge of the thermal print head and lie in a plane perpendicular to the transport path of the postage item, that the pressure elements exert a predetermined pressure on the postage item and the counterpressure element, and in that the thermal print head lies movably on the carrier web.

This solution proceeds from the requirement that the pressure by which the thermal print head lies on the carrier web and thereby on the postage compensatin to take on too high a value. The compensation of irregularities in the postage item by heavy pressure of the thermal print head is accordingly forbidden. The thermal print head must therefore lie in a constant manner on the carrier web independently of the different thicknesses of the postage item. The principal provided by the invention provides therefore that the adjustment of the pressure elements provided on both sides of the thermal print head, together with the stationary counterpressure element, assures adjustment of the carrier web and the thermal print head to a definite position relative to the postage item to be printed in the printing area. The postage item has by means of the stationary counterpressure element a deflection free position and obtains through the effect of the pressure elements in the printing zone its shape. Therefore the thermal print head can lie on the carrier web independently of these elements with a very reduced pressure, and thereby it can follow the irregularities of the postage item better than with a high pressure.

The inventive solution provides a moveable lying of the thermal print head on the carrier web. Therefore it is possible to first pre-adjust the pressure elements to positions suited to the current postage item and to then independently thereof bring the thermal print head to its operating position. This results then through the weight of the thermal print head, through spring force or by positive pressing, for example with an electromagnet. A spring force can through suitable choice of the spring sizes alone be optimally dimensioned for the printing process. Since independently thereof the postage item maintains its definite position by means of the two pressure rolls, its upper surface, especially perpendicularly to the transport direction, is smoothed and thereby the printing quality is made better.

A further development provides that the pressure elements are supported with variable spacing to the counterpressure element. Through this development the counterpressure elements can take on positions relative to the counterpressure element to suit different thicknesses of the postage item, in that the pressure elements upon appearance of the postage item in the transport nip are shifted and are then by their own weight or through spring pressure effective on the postage item and thereby exert the predetermined force. This further development can also advantageously be combined with a moveable counterpressure element.

Advantageously the counterpressure element is a counterpressure roll. This can also be coupled with a rotary drive of the postage meter so that it in the area of the transport nip, that is at the printing area, matches the predetermined speed of the postage item.

The counterpressure element can however, also be a slide member with a support surface for the postage item. This form of counterpressure element provides a flat support for the postage item and may especially be better suited to a large printing area in the transport direction, when for example several thermal print heads are provided.

The pressure elements can be pressure rolls or each an endless band on a roll pair. They are practically coupled with a rotary drive of the postage machine. These serve especially well for the embodiment wherein the counterpressure element is a slide member.

Figure 2:
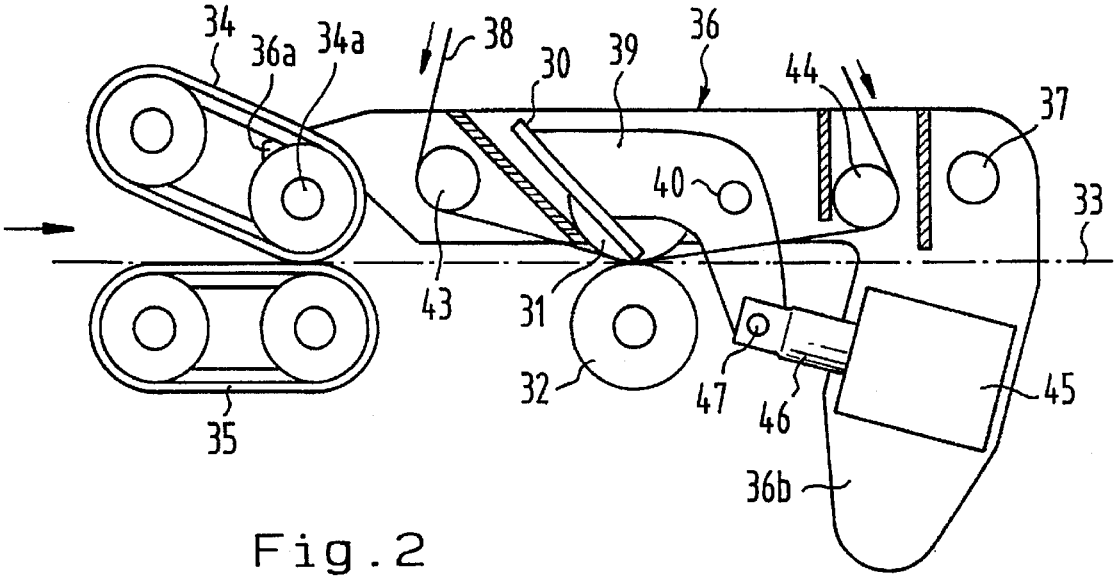
Figure 3:
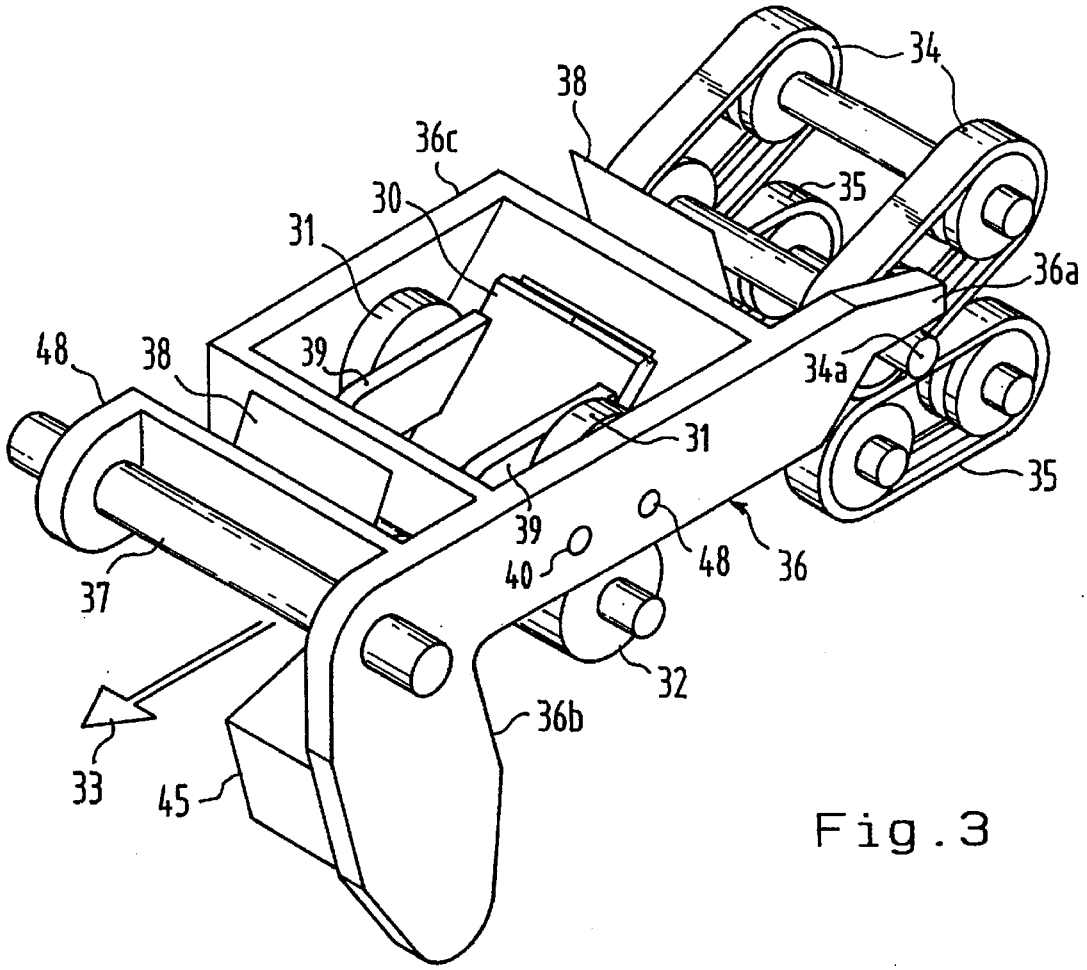
Figure 4:
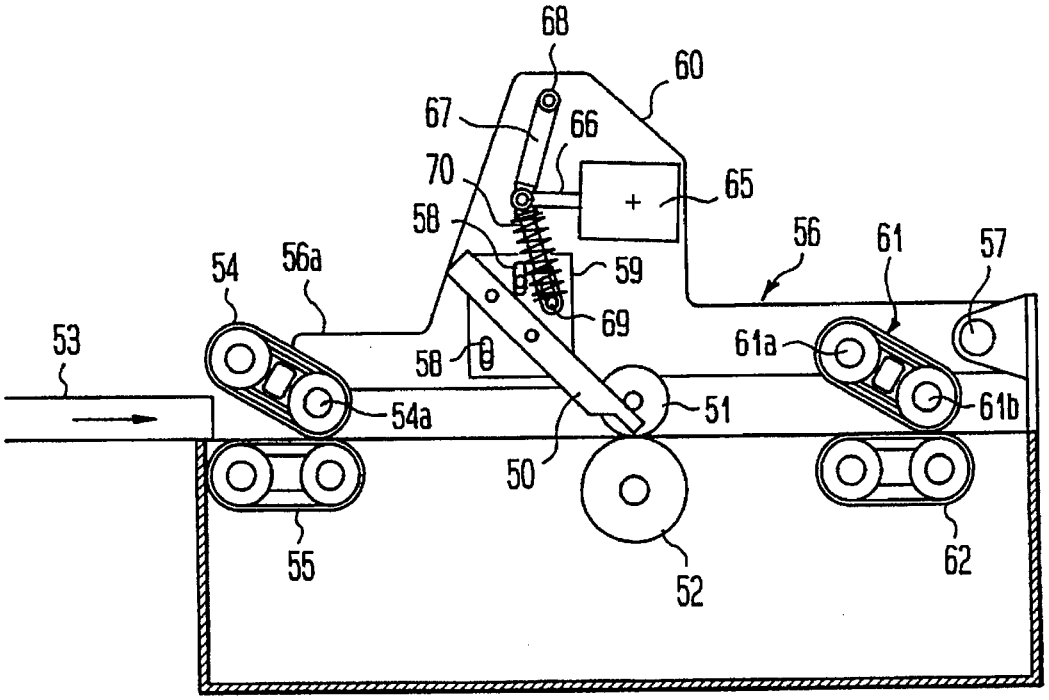
Figure 5:
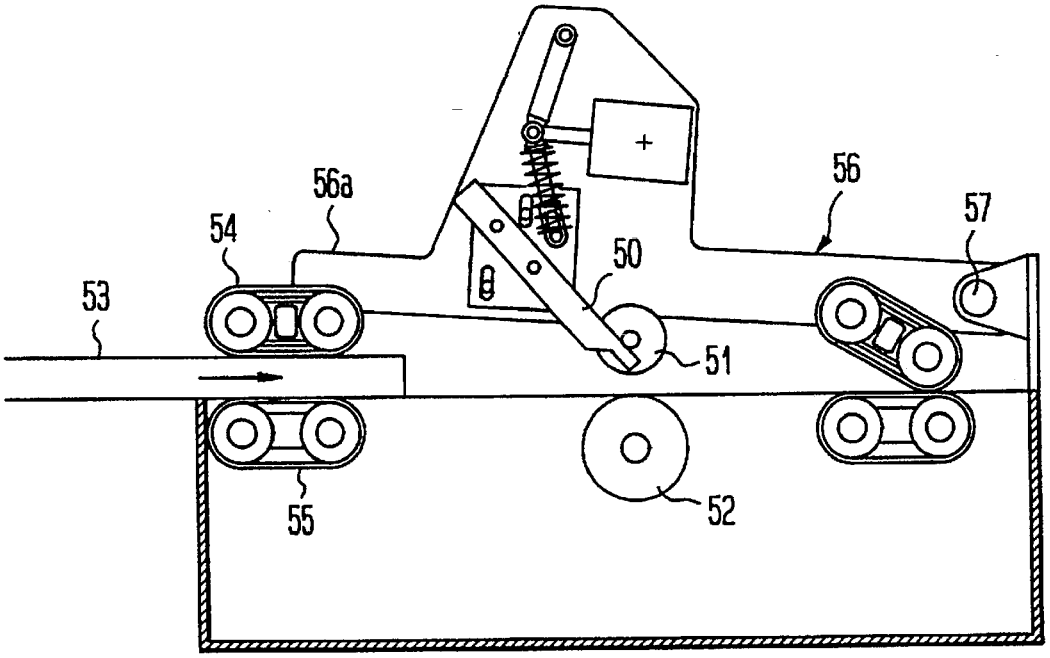
Figure 8:
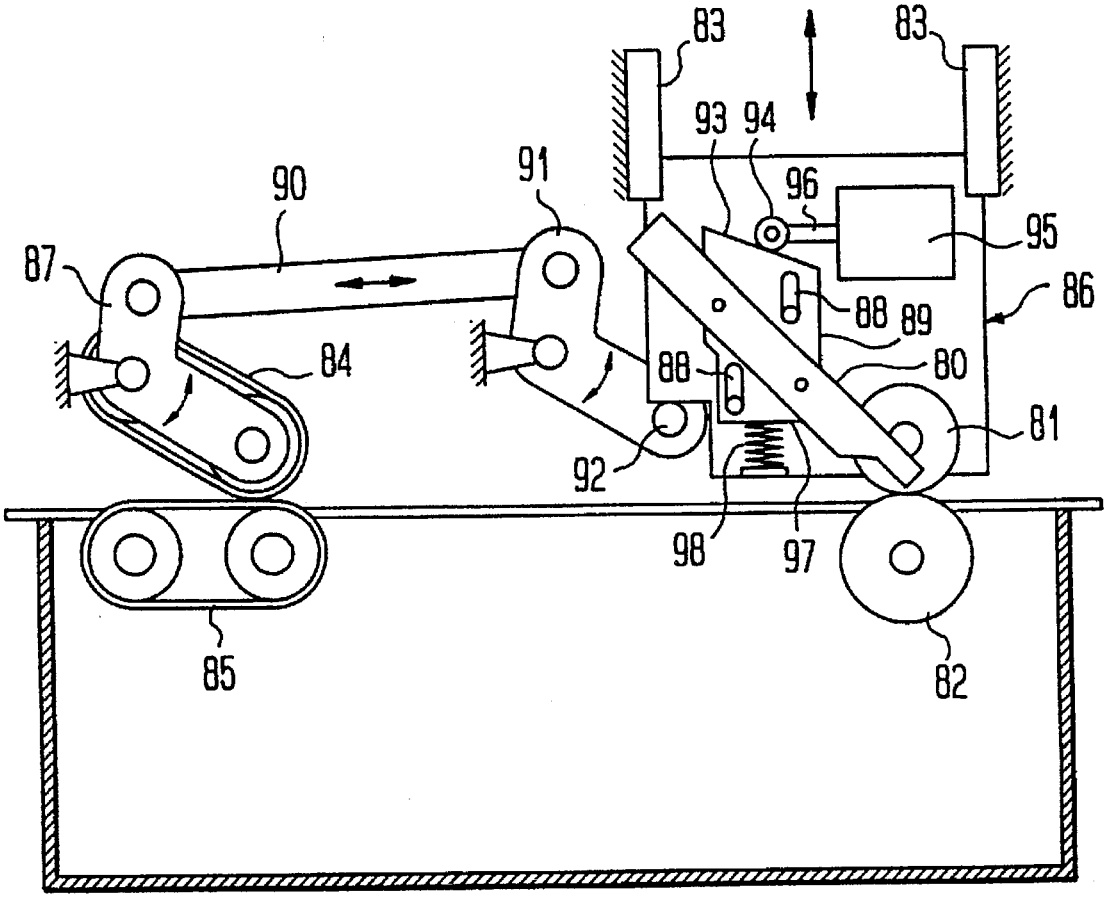
Figure 9:
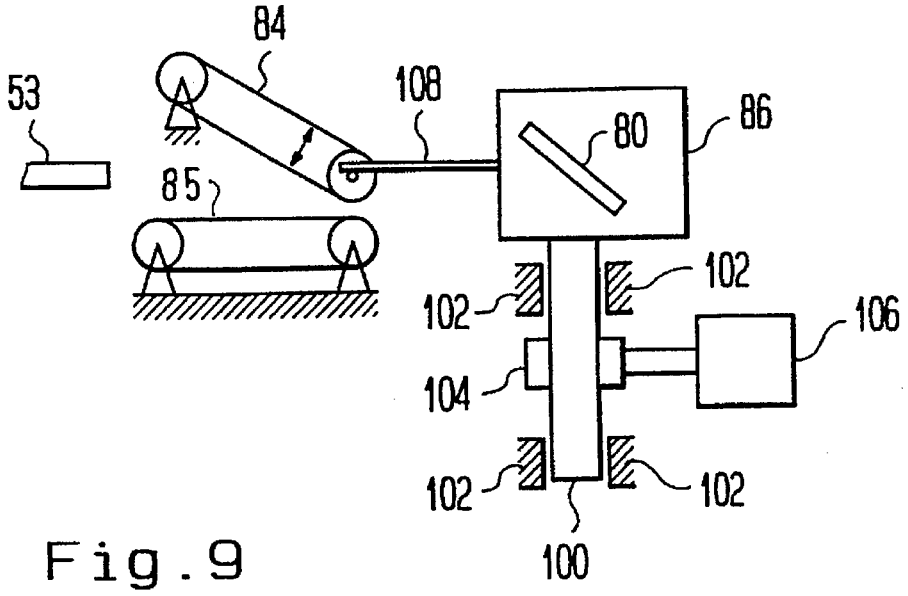
Figure 11:
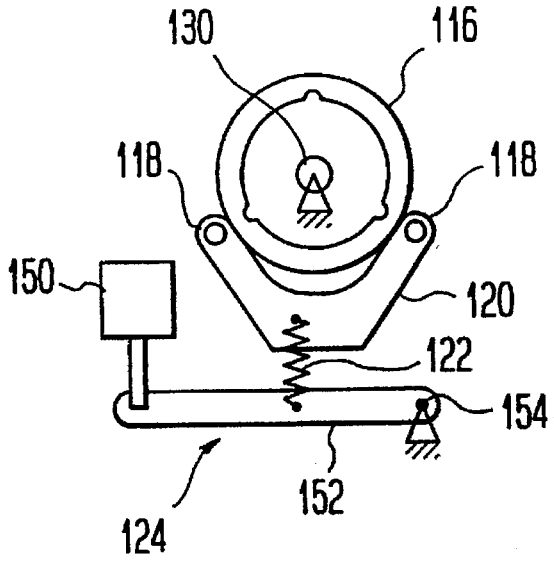
Figure 12:
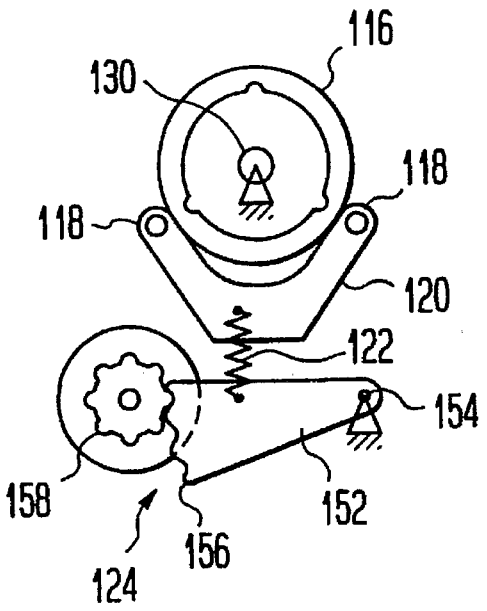
Figure 10A:
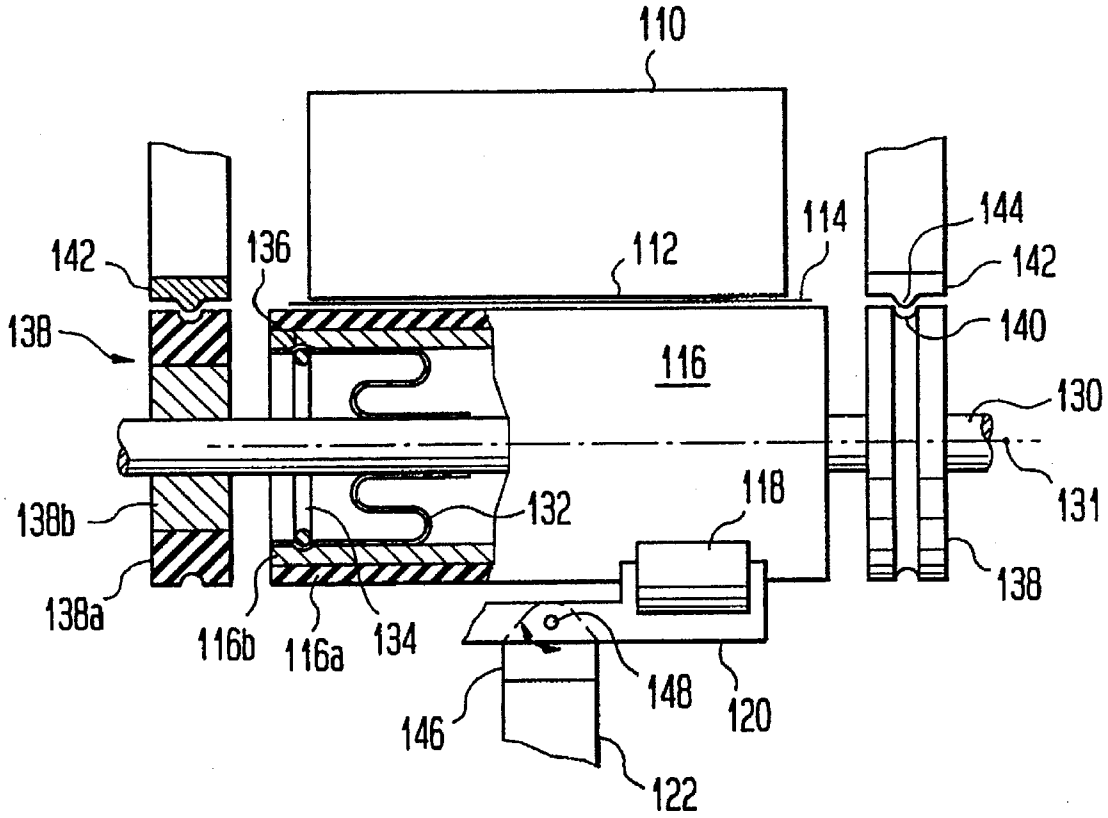
Figure 10B:
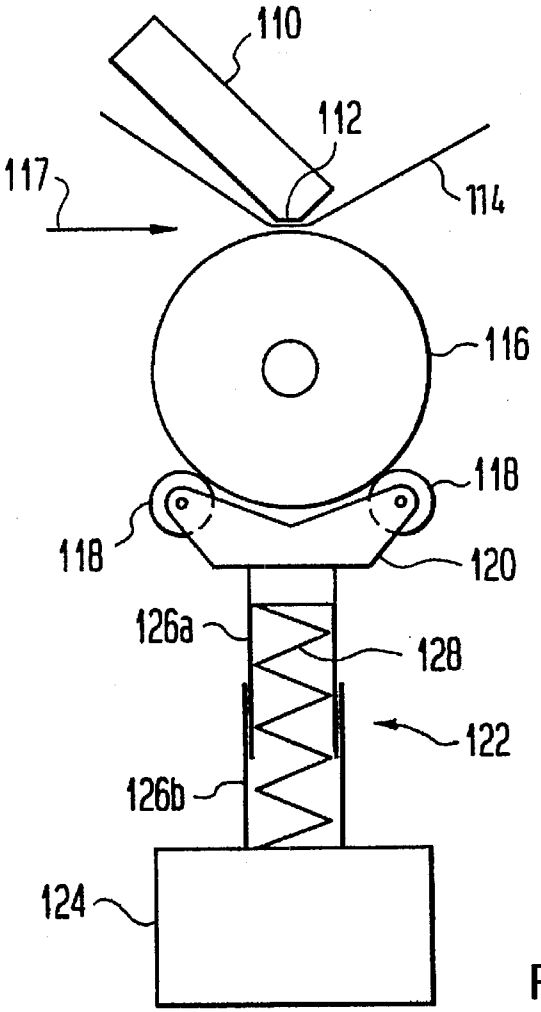
Figure 13:
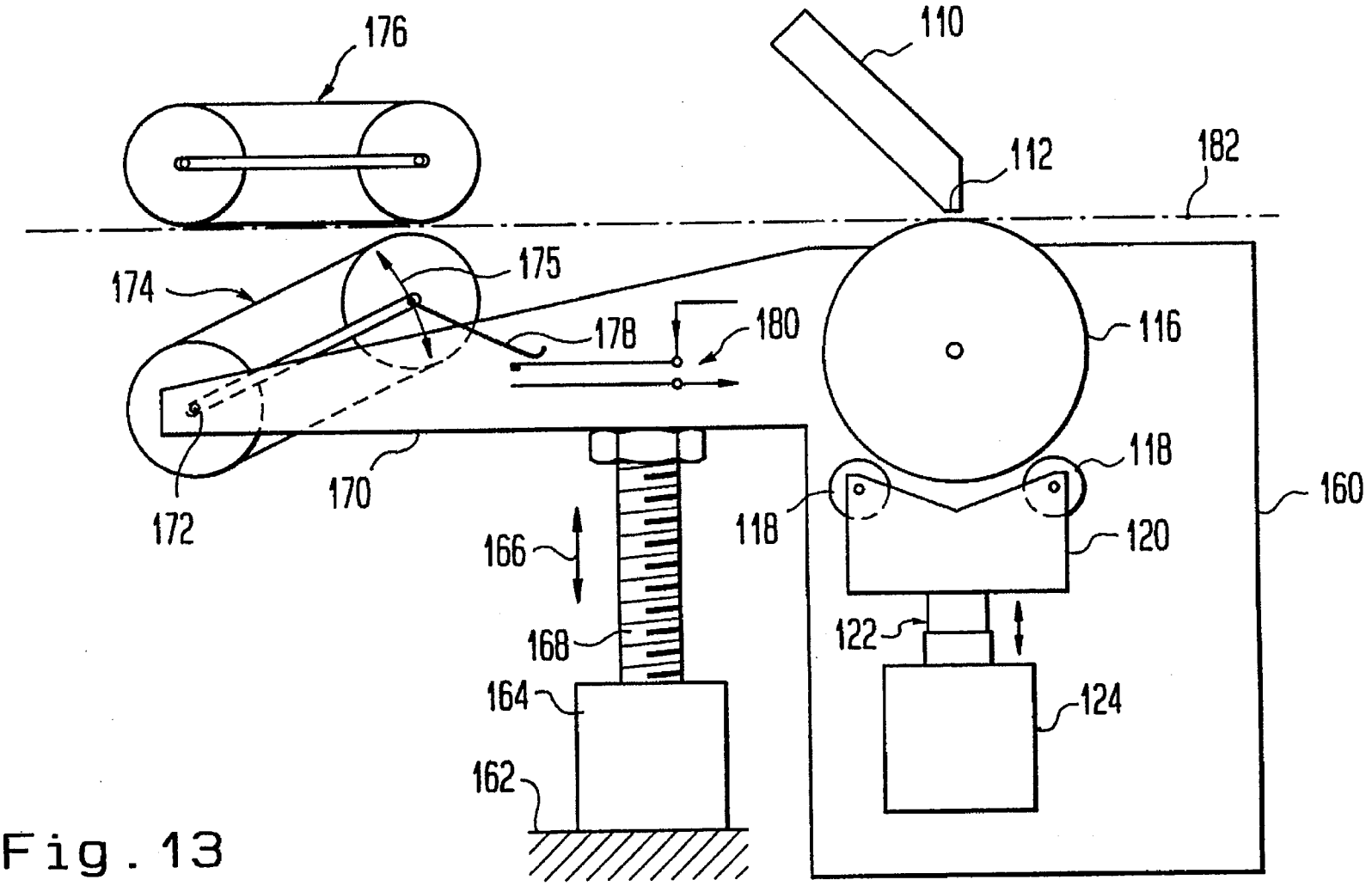

The invention is explained in the following in further detail in connection with the drawings. The drawings show:

FIG. 1 a schematic side view of the important parts of a postage meter, as an exemplary embodiment of the invention, working with a transport mechanism for a carrier web, FIG. 2 a longitudinal section of a pivotal arrangement for holding two pressure rolls and a thermal printing head in the printing region, FIG. 3 the apparatus of FIG. 2 in perspective representation, FIGS. 4, 5, a further embodiment of a postage meter in 6 and 7 schematic illustration in different drive positions, FIG. 8 a further embodiment of a postage meter in schematic representation, FIG. 9 an embodiment with an adjustable carrier, which by means of a clamping device is arrestable as to its height, FIG. 10A a partially broken away view, partly in elevation and partly in vertical section, of a fragmentary front view partly in elevation and partly in section of, an exemplary embodiment with a movably supported counterpressure roll, FIG. 10B a side view of the embodiment of FIG. 10A, FIG. 11 a positioning device for adjusting the counterpressure roll, FIG. 12 a positioning device with a driven gear, and FIG. 13 an arrangement by means of which the counterpressure roll can be adjusted to different thicknesses of the postage items.

In FIG. 1 the working principal of a postage meter is illustrated schematically by a side view, the postage meter operating according to the so called ETR-printing method, wherein a carrier web for the color particles is used, the web having a definite electrical resistance and thereby being selectively heatable. A current is conducted through the carrier web, which current is conducted from a thermal print head having printing electrodes through the carrier web to a collecting electrode. FIG. 1 shows an ETR-print head 10 arranged behind a pressure roll 11. A further pressure roll, not seen in FIG. 1, is located behind the thermal print head 10, so that therefore two pressure rolls are arranged on both sides of the print head 10. The pressure rolls 11 together with a counterpressure roll 12, located beneath them, form a transport nip for a letter.

The transport nip lies in the region of a conveying path 13 at the beginning of which are arranged input rolls 14 and 15 and at whose end are arranged discharge rolls 16 and 17.

A letter is inserted into the postage meter at the input nip formed by the input rolls 14 and 15.

The input rolls 14 and 15 are driven in the directions indicated by the arrows and move the letter into the transport nip formed by the pair of pressure rolls 11 and the counterpressure roll 12. Since the counterpressure roll 12 is coupled with the rotary drive of the postage meter, the letter is moved through the printing region of the thermal print head 10 and after the printing process reaches the nip between the discharge rolls 16 and 17, of which at least one, in the illustrated example the discharge roll 17, is coupled with the rotary drive of the postage meter. The letter is then discharged from the right hand end of the transport path 13, as viewed in FIG. 1.

A carrier web 18 is moved through the printing region of the thermal print head 10, the web, as is in itself known, consisting of a material with a definite electrical resistance or which can be coated with such a material and which carries color particles in a binding material meltable by a heating effect. These particles are transferred by selective heating of the carrier web 18 by means of the print electrodes of the print head 10, in a distribution corresponding to a graphic, from the carrier web 18 to the letter, which letter is at that time moving through the printing region between the pressure rolls 11 and the counterpressure roll 12. The carrier web 18 is supplied from a web supply spool 19 and is guided around a web drive roll 20 and a counterpressure roll 21. The web drive roll 20 is coupled with the drive of the postage meter and pulls the carrier web 18 from the supply spool 19. When the web supply of the supply spool 19 is exhausted, the carrier web 18 has the path illustrated by the broken line 22.

Following the counterpressure roll 21 the carrier web 18 is guided around a guide rod 23, which functions as a collecting electrode, and arrives then in a nearly horizontal path at the printing region of the print head 10. The guide rod 23 connects the carrier web 18 with ground potential and therefore effects a current conduction from the carrier web to ground. The current is delivered to the carrier web 18 by means of the printing electrodes of the print head 10, which is connected with a control circuit not illustrated in FIG. 1, which control circuit is known in itself and controls the printing procedure and the selective control of the printing electrodes of the print head 10.

The carrier web 18 has a width corresponding to the width of the thermal print head 10 (see FIG. 3), so that it moves forwardly between the pressure rolls 11. It is moved out of the printing zone and arrives then at direction changing elements 24 which can be made as guide rods or as idling rollers. From there it is delivered to a web take up spool 25, driven in the counterclockwise direction as indicated by the arrow in FIG. 1, which rolls up the carrier web 18 until it is filled. The carrier web 18 then has the path illustrated at 27.

It is to be seen from FIG. 1 that the thermal print head 10 operates on the upper side of the carrier web 18, and that the letter to be printed must run under the carrier web 18 through the printing region, with the color particles then being transferred in a graphic forming distribution from the carrier web 18 onto the letter.

A longitudinal section is illustrated in FIG. 2 in which the principal of a thermal print head movably supported independently of the pressure elements can be realized in a postage meter. Here a common carrier serves for the pressure rolls 31 and for the thermal print head 30, on which carrier the thermal print head 30 is movably supported and which carrier on its own part can be moved by means of a letter to be printed. This carrier has the form of a rocker 36 formed as a kind of angular lever and pivotally supported at a fixed pivot axis 37 to a non-illustrated postage meter frame. The pivotal movement takes place such that the horizontal portion of the rocker 36 moves relative to the transport path 33 toward or away from such path as seen in FIG. 2. This movement is produced when a letter on the left hand side of the arrangement moves in the arrow illustrated direction between two input tractor arrangements 34 and 35 and lifts the upper tractor arrangement 34 by its thickness, so that the rocker which has its end **36*a* lying on the lower axle 34*a* of the tractor arrangement 34 is lifted by the letter thickness. Thereby the pressure rolls 31, of which only one is to be seen in FIG. 2, are lifted relative to the counterpressure roll 32, since they are supported on the rocker 36, as can be better understood from FIG. 3**.

On the rocker 36 are also direction changing elements 43 and 44 for a carrier web 38 guided in the direction of the arrow from a non-illustrated supply spool and to a likewise non-illustrated takeup spool. On the horizontal portion of the rocker 36 a holding device 39 is pivotally supported at 40 for the thermal print head 30. This holding device 39 consists of two bell cranks, of which only one is seen in FIG. 2. At its end facing away from the thermal print head 30 the holding device is coupled at 47 with the armature 46 of an electromagnet 45. The electromagnet 45 is connected at its rear part 36b to the rocker 36.

The rocker 36 is pivoted by the weight of its horizontal portion and the pressure rolls 31 in the direction toward the counterpressure roll 32 so that the left hand end **36*a*, in FIG. 2, of the horizontal portion of the rocker 36 lies on the lower axle 34*a* of the input tractor arrangment 34. When this is lifted by a letter inserted from the left the horizontal portion of the rocker is also lifted whereby a height adjustment of the thermal print head is achieved by the letter, and the pressure rolls 31 exert a predetermined pressure force onto the inserted letter when it moves over the counterpressure roll 32**.

Preferably, at the moment the forward edge of the letter encounters the counterpressure roll 32 the control of the postage meter actuates the electromagnet 45 so that the bell cranks 39 carrying the thermal print head 30 are pivoted in the counterclockwise direction (FIG. 2) and the thermal print head 30 is lowered toward the carrier web 38 to its operating position. The print head 30 and the electromagnet 45 are shown in this position in FIG. 2. After the printing process is ended by the movement of the letter through the printing region, the print head 30 can be lifted again from the carrier web 38 to its rest position by the turning off of the electromagnet 45 and the moving out of its armature 46.

From FIG. 2 it can be seen that independently of the dimensions of the individual parts used as well as of the movement paths required by the movement through the lever ratio, on one hand the force of the pressure roll 31 on a letter in the transport nip, and on the other hand the pressure force of the thermal print head 30 on the carrier web 38, can be individually determined.

In FIG. 3 is illustrated a rocker arrangement in its entirety, which arrangement includes the device illustrated in FIG. 2. The perspective illustration serves to provide a view of the rear side of the apparatus illustrated in FIG. 2. The rocker 36 is provided with a carrier frame **36*c* for the pressure rolls 31 and for the thermal print head 30. On the rocker 36 the support position for the right pressure roll 31 is seen at 48. The left pressure roll 31 is likewise supported in the opposite part of the carrier frame 36*c*. Also the support axle 40 for the two bell cranks 39 can be seen, onto which bell cranks the thermal print head 30 is fastened. The rocker 36 rests with its right hand (in FIG. 3) and tapered end 36*a* on the lower axle of the upper input tractor 34, which consists of two tractor bands guided on rollers. These tractor bands lie above the tractor bands of the lower input tractor 35**.

A postage meter is schematically illustrated in four different operating positions in FIGS. 4 to 7. Its operation is similar to the arrangement shown in FIGS. 2 and 3, but a common carrier for the thermal print head and the pressure rolls is not subjected to a spring force, but instead the pressure of the pressure rolls on a letter to be printed is determined by its own weight. The carrier web for the color particles is not illustrated in FIGS. 4 to 7.

FIG. 4 shows at the left portion of the postage meter two input tractor arrangements 54 and 55, between which a letter 53 to be printed can be inserted in the illustrated arrow direction. The thermal print head 50 is fastened to a carrier plate 59, which on its part is vertically slidably connected to a rocker 56 in elongated guide holes 58. The rocker at 57 is pivotally connected to a frame of the postage meter and at its left hand end **56*a* in FIG. 4 rests on the lower axle 54*a* of the input tractor arrangement 54, so that it will be lifted by the axle when the letter 53 is pulled in between the two input tractor arrangements 54 and 55**.

At the right hand end of the letter transport path are further illustrated the discharge tractor arrangements 61 and 62. The upper discharge tractor arrangement 61 is connected to the rocker 56 by its upper axle **61*a* and rests with its lower part 61*b*** on a letter, as soon as the letter is moved to the right out of the postage meter following the printing process.

The printing head 50 lies with its printing ledge in the printing region between pressure rolls 51 and a counterpressure roll 52. The arrangement of this part corresponds to that shown in FIGS. 2 and 3. An electromagnet 56 is fastened to an upper plate part 60 of the rocker 56, which electromagnet is connected by its armature 66 to the joint point of a knee joint 67. The knee joint at its upper end 68 is connected to the plate part 60 and at its lower end is guided by an elongated hole on a pin 69 fastened to the carrier plate 59. The lower part of the knee joint 67 is provided with a compression spring 70 which works between the joint point and the pin 69.

The pressure rolls 51 are supported by a lower projection of the rocker 56 not seen in FIGS. 4 to 7.

FIG. 5 shows the device illustrated in FIG. 4 in an operating condition in which the letter 53 to be printed is conveyed between the input tractor arrangements 54 and 55. The rocker 56 is pivoted upwardly about the pivot axis 57 by the lifting of its left hand end 56*a*, so that the pressure rolls 51 have a spacing from the counterpressure roll 52 which is smaller than the letter thickness so that upon the later reaching of this position by the letter 53 the rocker 56 is further lifted and then exerts by its own weight a predetermined pressure force through the pressure rolls 51 and the letter 53 on the counterpressure roll 52. At the same time the thermal print head 50 is moved forwardly.

Figure 6:
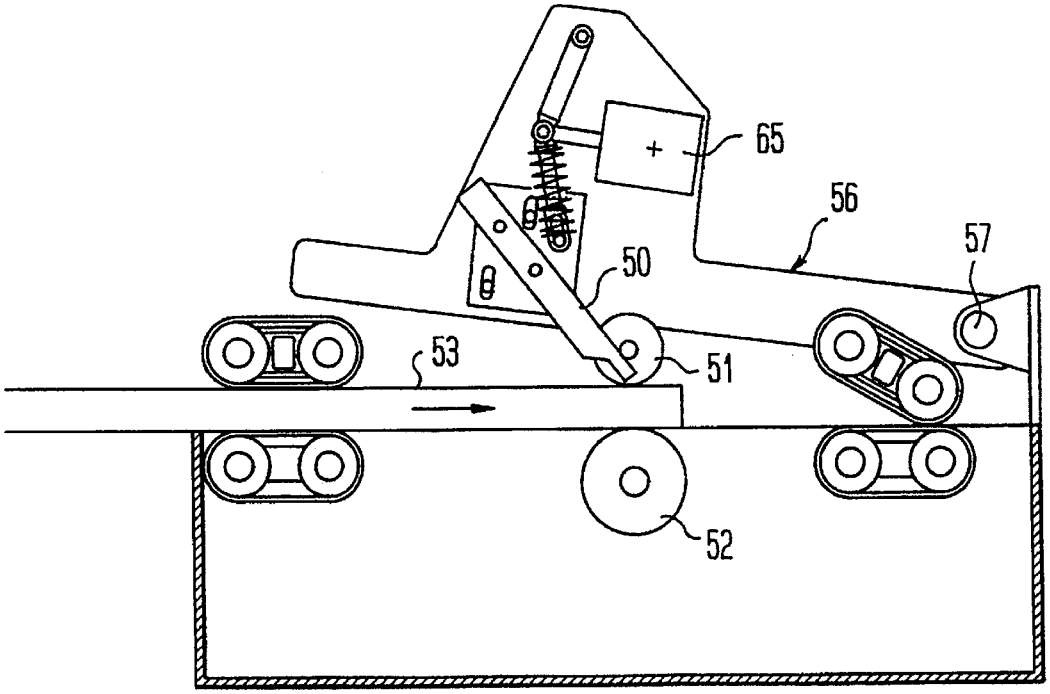

FIG. 6 shows the operating condition in which the letter 51 has come with its forward edge between the pressure rolls 51 and the counterpressure roll 52. Thereby the rocker 56 is further lifted and the thermal print head 50 is pre-adjusted. At this moment the electromagnet 65 should be actuated in order to move the thermal print head 50 into the printing region.

Figure 7:
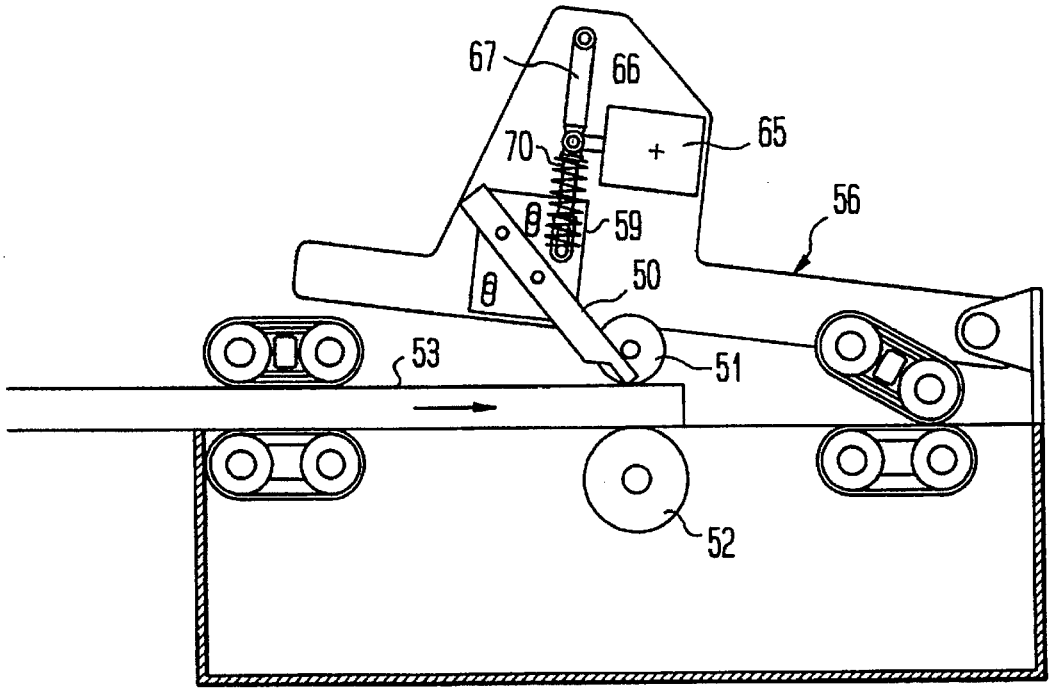

This operating condition is shown in FIG. 7. The electromagnet 65 has its armature 66 pulled in and thereby the knee joint 67 is extended. As a result of this the carrier plate 59 is pushed downwardly by the compression spring 70 so that the print head 50 now lies on the non-illustrated carrier web in the printing region and applies to the letter 53 a pre-determined printing pressure. That is, there is exerted on the carrier web and on the letter 53 a pressure which is determined by the force of the compression spring 70. The letter 53 is transported further between the pressure rolls 51 and the counterpressure roll 52 until it is discharged from the right side of the device.

FIG. 8 shows a postage meter in which the thermal print head 80 is held by a carrier 86 for a pressure roll 81, which can be linearly shifted relative to a counterpressure roll 82 and for this purpose is guided by two stationary guides 83. The movement of the carrier is achieved by means of an input tractor arrangement 84 which is lifted by a non-illustrated letter when the letter is located between the input tractor arrangement 84 and a lower input tractor 85. The input tractor arrangement 84 is supported on a bell crank 87 pivotally moveable about a fixed axis. The upper arm of the bell crank 87 in FIG. 8 is coupled through a rod 90 with the upper arm of a further bell crank 91 pivotally supported for movement about a fixed axis, the shape and size of the bell crank 91 corresponding to that of the bell crank 87. If the bell crank 87 is pivoted in the counterclockwise direction, the bell crank 91 executes a corresponding pivotal movement and thereby lifts the carrier 86 by means of a pin 92 to a degree which corresponds to the thickness of the letter located between the input tractor arrangements. In this way the thermal print head 80 is pre-adjusted to a corresponding height.

The thermal print head 80 is held to the carrier 86 by means of a carrier plate 89 which can be slid upwardly and downwardly and which for this purpose is guided by means of elongated guide holes 88 on pins of the carrier 86. The carrier plate 89 has an inclined upper edge 93 on which the horizontally slidable armature 96 of an electromagnet 95 is guided by means of a roll 94. The bottom edge 97 of the carrier plate 89 rests on a spring 98, by means of which it is biased upwardly and which with its lower end engages the carrier 86.

When the electromagnet 95 is turned on its armature 96 moves leftwardly and presses the carrier plate 89 downwardly at its upper inclined edge 93, so that the thermal print head 80 is thereby moved out of its pre-adjusted position to its final operating position, as is the case in the previously described embodiments. The type of drive illustrated in FIG. 8 for the carrier plate 89 can also be used for the carrier plate 59 of the embodiment shown in FIGS. 4 to 7.

An embodiment is sketched in FIG. 9 in which the carrier 86, as in the example of FIG. 8, is linearly slidable in its height relative to a non-illustrated counterpressure roll. The carrier 86 with the thermal print head 80 is arranged on a column 100 which is slidably supported in fixed bearings 102. A clamping band 104 is slung around the column 100 and can be controlled through an electromagnet 106 between a rest condition, at which it loosely surrounds the column 100, and a clamping condition at which it clamps the column 100 fast at exactly its then present condition. When a postage item 53 is moved through the input tractor arrangements 84, 85 the upper input tractor arrangement 84 is lifted in accordance with the thickness of the postage item 53. This movement in height is transferred through a connecting arm 108 to the carrier 86, which with a loosened clamping band 104 moves the column 100 in the bearings 102, so that the thermal print head 80 takes on a pre-adjusted height relative to the counterpressure element (not illustrated).

In this position the electromagnet 106 is actuated, so that the clamping band 104 arrests the column 100. During the movement of the postage item past the thermal print head 80 the carrier 86 remains in its arrested position. With this embodiment an increased pressure force can be applied to the postage item 53 for the printing, without the existence of any relative movement between the counterpressure element and the carrier 86. This embodiment is especially useful in connection with the ETR-method, in which a relatively high printing force is required.

In the following examples a moveable position counterpressure element is described which cooperates with a fixed position thermal print head. In FIGS. 10A and 10B the fixed position ETR-thermal print head 110 has a printing ledge 112 equipped with printing electrodes which press against an ETR-carrier web 114 provided with a resistance coat. The printing ledge 112 presses directly against a counterpressure roll 116 which is rotatably supported on rolls 118. The rolls 118 are held in an angular spacing from one another by a carrier in the form of a fork 120 which is connected with an adjusting device 124 through an elastically yieldable holding element 122. The holding element 122 has two cylinder faces 126*a* and 126*b* slidable in one another and which receive a helical spring 128. The holding element 122 has the effect that the upper jacket face of the counterpressure roll 116 is yieldingly slidable in the direction perpendicular to the printing surface and the printing ledge 112 of the print head 110 and exerts a predetermined pressure on the printing surface. The adjusting device 124 has two positions: in a pushed forward operating position it presses the counterpressure roll 116 against the postage item (not illustrated) transported in the direction of the arrow 117; in a withdrawn rest position the counterpressure roll 116 is removed from the printing ledge 112 of the print head 110.

In FIG. 10A further details of the device can be seen in a partially cut away view. The counterpressure roll 116 is supported on a shaft 130 whose rotational axis 131 is fixed in place. The shaft 130 is driven on one side by a non-illustrated transport motor. The counterpressure roll 116 has an outer jacket 116*a* of rubber connected with a hollow cylinder 116*b* of aluminum. The hollow cylinder at both ends is connected in a rotationally fixed way with the shaft 130 by a bellows 132, of which in FIG. 10A only the left hand portion is visible. The bellows 132 is fastened through a spring ring 134 which presses one end of the bellows into an annular recess 136 of the hollow cylinder 116*b*. The bellows 132 is connected to the shaft 130 by means of adhesive or other connecting means. A further possibility for the connection is that the shaft 130 in the area of the bellows 132 is formed with a plurality of flat surfaces which engage the end of the bellows 132 with a form fitting connection.

Further, two wheels 138 are non-rotatably fixed to the shaft, which wheels have the same outer diameter as the counterpressure roll 116. The wheels 138 have an outer ring 138*a* of rubber and a core ring 138*b* of aluminum, which is fixed to the shaft 130. A groove 140 is formed in the running surface of each wheel 138. Arranged above each wheel 138 is a friction spring 142 as a pressure element, which springs for purposes of a better view have been omitted in FIG. 10B. The friction springs 142 have protrusions 144 which cooperate with the grooves 140.

The roll 118 carrying fork 120 is connected with the holding element 122 through a rotary joint 146 whose rotational axis 148 is nearly perpendicular to the longitudinal axis 131 of the shaft 130 and nearly parallel to the transport direction of the postage item. The counterpressure roll 116 can therefore partake of pivotal movements about. the rotational axis 148.

During the drive of the postage meter the shaft 130 is driven by the transport motor (not illustrated) for the transport of the postage item. The wheels 138 and the counterpressure roll 116 receive the postage item and convey it by frictional contact through the transport nip formed between the transport wheels 138, the counterpressure roll 116, the friction spring 142 and the thermal print head 110. When the postage item contains a part bulging its upper surface outwardly, for example a paper clip or a coin, the bearing surface of the counterpressure roll 116 lying against the postage item takes on a tilted position, in the plane containing the printing ledge 112 and the shaft 120, about the rotational axis 128, which assures that a uniform pressure is exerted onto the postage item in the direction perpendicular to the transport direction along the length of the printing ledge 112. The printing electrodes of the thermal print. head 110 thereby remain always in contact with the ETR-carrier web 114 which again stands in contact with the upper surface of the postage item. Therefore, color particles from the carrier web 14 can also be transferred in a similar way even in the case of the postage item having a non-planar upper surface. The surface pressure created by the counterpressure roll 116 is adjusted by means of the helical spring 122, which by the adjusting device 122 is pressed in an upwardly directed direction in FIG. 10A and 10B. After the resulting printing step and the passage of the postage item the adjusting device 124 is moved to its rest position in which the counterpressure roll 116 is spaced from the print head 110.

Through the use of the bellows 132 and the support of the jacket 116*a* on the roll 118 a reciprocating movement of the holding element 122 produced by the spring 128 is transferred to the jacket surface of the counterpressure roll 116 engaging the postage item, without the shaft axis 131 being displaced. Also pivotal movements of the jacket surface about the rotational axis 128 are possible without displacing the shaft axis 131. The jacket surface facing the postage item elastically engages the postage item on its upper surface so that even in the case of a non-planar upper surface a uniform pressure is produced. In practice the reciprocating movement of the jacket surface amounts to about 3 mm.

In FIG. 11 an exemplary embodiment of the adjusting device 124 is shown in more detail. An electromagnet 150 actuates a lever 152 whose end is rotatable about a positionally fixed rotational bearing 154. The schematically illustrated holding element 122 is moved up and down by the lever 152. The illustration according to FIG. 11 assumes that the shaft 130 is arranged in a fixed position. The surface of the jacket facing away from the counterpressure roll 116 is supported by the rolls 118. Because of the chosen arrangement, upon a movement of the fork 120 in the direction of the postage item the jacket surface of the counterpressure roll 116 and therewith the contact surface can be moved up and down without the shaft 130 having to be moved along with such movement. The shaft 130 can therefore take a position eccentric to the counterpressure roll 116. Thereby there results an entirely stable arrangement which nevertheless is movable to a high degree and has sufficient stiffness to be able to transfer the printing force.

In FIG. 12 the lever 142 has at its end a toothed area 136 which meshes with a gear 158. Upon rotation of the gear 158, which for example is driven by a motor, the lever 142 executes up and down movements and permits along with a movement to the above described operating position also an adjustment of the pressure of the counterpressure roll 116 on the postage item.

FIG. 13 shows an arrangement by means of which the spacing of the counterpressure roll 116 from the printing ledge 112 of the thermal print head 110 can be pre-adjusted independently of the thickness of a postage item. The adjusting device 124 carrying the counterpressure roll 116 is fastened to a plate 160 which is supported opposite to a base plate 162 fastened to the housing of the postage meter and is slidably supported through a spindle drive 164. The spindle drive 164, driven by a motor (not illustrated), has a spindle 168 fastened to an arm 170 of the plate 160. By actuation of the motor the arm 170 and with it the counterpressure roll 116 are, together with the adjusting device 124, adjusted in the direction indicated by the arrow 166 relative to the base plate 162. On the arm 170 is fastened a tractor arrangement 174 rotatably supported for movement about a rotational axis 172, so that the tractor arrangement can move pivotally in the direction of the arrow 175. The pivotal movement is transferred through a connecting arm 178 to a switch 180 which upon displacement of the tractor arrangement 174 along a predetermined path, for example 3mm, creates a switch signal. This switch signal is delivered to the motor of the spindle drive 164, which adjusts the spindle 168 for a period of time until the switch signal is no longer provided.

An upper, fixed in place tractor arrangement 176 is arranged to lie above the lower tractor arrangement 174, the transport band of the upper tractor arrangement and the printing ledge 112 of the print head 110 defining a transport plane 182.

Upon operation of the postage meter the tractor arrangements 176, 174 convey a postage item. According to the thickness of the postage item, the lower tractor arrangement 174 is pivoted downwardly, whereupon the connecting arm 178 effects a closing of the switch 180. The switch signal of the switch 180 produces an adjustment of the spindle 168 and therewith of the plate 160 in a direction increasing the spacing between the bearing surface of the counterpressure roll 116 and the printing ledge 112. In a position defining the rest position of the tractor arrangement 174 the switch 180 opens again and the switch signal disappears. The motor of the spindle unit 168 is stopped and the plate 160 then has a position in which the counterpressure roll 116 is pre-adjusted nearly to the thickness of the postage item. Upon transport of the postage item along the transport plane 182 it is pressed by the counterpressure roll 116 directly against the printing ledge 112, with the counterpressure roll 116 being capable of undertaking deflecting movements corresponding to the unevenness of the postage item. Because of the pre-adjustment of the counterpressure roll to the thickness of the postage item the deflecting movements of the counterpressure roll remain within a small region so that it presses against the postage item with nearly constant force.

Within the realm of the present invention many modifications and combinations are possible. For example the arrangement illustrated in FIGS. 10A and 10B with a movable counterpressure roll 116 can be combined with an arrangement such as illustrated in FIG. 8 and in which a movable thermal print head 80 is pre-adjusted to the thickness of the postage item. The thermal print head 80 illustrated in FIG. 8 can in a variation be arranged in fixed position on the carrier 86.

Further it is possible that the pre-adjusting device illustrated in FIG. 13 can be equipped with a clamping device according to FIG. 9 instead of a spindle drive. In a reverse manner the sensing arrangement formed by the tractor arrangement 174 and switch 180 for sensing the thickness of the postage item and for adjusting the spacing between the thermal print head and the counterpressure element by means of a spindle drive can also be used in an apparatus according to FIG. 9.

We claim:

1. A postage meter with a base, and an electrothermal printing device by means of which value indications and/or graphics can be printed by the transfer in a graphic forming distribution of color particles from a carrier web on to a postage item while the postage item and carrier web together move past the printing device at a predetermined speed, wherein said printing device comprises:

a thermal print head fixed relative to said base and having a printing ledge for heating said carrier web in correspondence to said graphic forming distribution as said postage item and web are moved past the printing device, a counterpressure element positioned opposite to the thermal print head so that said postage item and said carrier web pass between said thermal print head and said counterpressure element, means supporting said counterpressure element for movement toward and away from said thermal print head motorized means associated with said supporting means for moving said counterpressure element toward and away from said print head, motorized means for driving said counterpressure element to transmit movement in a transport direction to the postage items passing between said print head and said counterpressure element, and means for causing said print head and counterpressure element to apply a substantially uniform pressure between a postage item and the carrier web independent of differences in the thicknesses of the postage items and uneven stuffing of the postage item in the direction perpendicular to said transport direction.

2. A postage meter as defined in claim 1 wherein:

said counterpressure element comprises a hollow cylinder, and said means supporting said counterpressure element includes a shaft arranged for rotation about an axis parallel to said printing ledge of said spring head and transverse to said transport direction, and means connected between said shaft and said hollow cylinder for causing said shaft and hollow cylinder to rotate in unison about said axis while permitting said hollow cylinder to take on different angles relative to said printing ledge in a plane perpendicular to said transport direction.

3. A postage meter as defined in claim 1, wherein:

said counterpressure element is a counterpressure roll, said means supporting said counterpressure element includes a member rotatable about an axis parallel to said printing ledge of said print head and transverse to said transport direction and a means for angularly fixing said roll to said member so that said roll surrounds said axis and is constrained to rotate with said member about said axis, and said motorized means for driving said counterpressure element is a motor drivingly connected with said member for rotating it and said roll about said axis.

4. A postage meter as defined in claim 1, wherein:

said means for causing said print head and counterpressure elements to apply a substantially uniform pressure between an envelope and said carrier web including a first biasing means associated with said supporting means for elastically urging said counterpressure element toward said print head to allow said counterpressure element to compensate for different thicknesses of postage items by moving toward and away from said print head under the influence of said first biasing means, and a second biasing means associated with said counterpressure element for elastically urging said counterpressure element to a given position about an axis extending parallel to said transport direction to allow said counterpressure element to move about said axis under the influence of said second biasing means to compensate for uneven stuffing of the postage items in the direction transverse to said transport direction.

5. A postage meter with an electrothermal printing device by means of which printing device value indications and/or graphics are printed on to a printing surface provided by a postage item moved in a path past the printing device at a predetermined speed by the transfer of color particles in a graphic forming distribution from a carrier web (114) moved with the postage item past the printing device, wherein said printing device comprises:

a thermal print head (110) for heating a carrier web (114) in correspondence to a graphic forming distribution and having a printing ledge (112), a counterpressure element (116) standing opposite to the thermal print head (110), said counterpressure element being a counterpressure roll (116) movable in a direction perpendicular to said printing surface and having an external contact surface, and means for yieldingly supporting said counterpressure roll on a shaft (130) arranged parallel to the printing ledge (112) of the thermal print head (110) so that said contact surface of said counterpressure roll when it contacts a postage item can take on different angles to the printing ledge (112) in a plane containing the printing ledge (112 and the shaft (130).

6. A postage meter as defined in claim 5, wherein: said thermal print head (110) is stationary.

7. A postage meter as defined in claim 5, wherein:

said counterpressure roll (116) at its ends is non-rotatably connected with the shaft (130) by means of a spring device (132).

8. A postage meter as defined in claim 7, wherein:

said spring device a bellows (132) made of an elastic material.

9. A postage meter as defined in claim 5, wherein:

said counterpressure roll (116) is supported on a fork (120) which is connected with a holding element (122) through a rotatable joint (146) whose axis of rotation (148) is at least nearly perpendicular to the longitudinal axis of the shaft (130) of the counterpressure roll (116) and at least nearly parallel to said path.

10. A postage meter as defined in claim 9, wherein:

said fork (120) has at least two rolls (118) which rotatably support the counterpressure roll (116) on the side facing away from the thermal print head (110) at points spaced angularly from one another about the circumference of the roll.

11. A postage meter as defined in claim 9, wherein:

said holding element (122) includes an elastic part which is deformable in the direction perpendicular to the printing ledge (112) of the thermal print head (110).

12. A postage meter as defined in claim 5, wherein:

said printing device further includes an adjusting device (124) for adjustably positioning said counterpressure roll along an axis running perpendicularly to said path of the postage item.

13. A postage meter as defined in claim 12, wherein:

said adjusting device (124) includes means for adjusting the counterpressure roll (116) between an operating position, in which the counterpressure roll (116) is pressed against the postage item by spring pressure, and a rest position, in which the counterpressure roll (116) is removed from the thermal print head (110).

14. A postage meter as defined in claim 13, wherein:

said adjusting device (124) includes a reciprocating magnet.

15. A postage meter as defined in claim 13, wherein:

said adjusting device (124) includes a lever mechanism (152, 154) actuated by an electromagnet (150).

16. A postage meter as defined in claim 13, wherein:

said adjusting device (124) includes a toothed member 156 which is shiftable by a driven gear (158).

17. A postage meter as defined in claim 5, wherein:

two wheels (138) are non-rotatably connected with the shaft (130) of the counterpressure roll (116), said wheels being spaced from one another and said counterpressure roll (116) being arranged between said wheels.

18. A postage meter as defined in claim 17, wherein:

associated with each of said two wheels (138) as a pressure element is a friction spring (142) arranged opposite the wheel and which exerts a predetermined pressure on the wheel.

19. A postage meter as defined in claim 17, wherein:

said two wheels (138) and said counterpressure roll (116) have similar diameters.

20. A postage meter as defined in claim 5, wherein:

said printing device includes a pre-adjusting device (174, 164, 160) which adjusts the counterpressure roll (116) to a spacing relative to the printing ledge (112) of the thermal print head (110) in dependence on the thickness of the postage item.

21. A postage meter as defined in claim 20, wherein:

said pre-adjusting device includes a positioning motor, and said printing device includes a sensor (174, 178, 180) for sensing the thickness of said postage items as it moves along said path toward said thermal print head and for providing a signal related to the sensed thickness for controlling said positioning motor of said pre-adjusting device (160, 164, 168) when a pre-given thickness of the postage item is exceeded.

22. A postage meter as defined in claim 21, wherein:

said counterpressure roll (116) is arranged on a carrier (160) which holds a transport device (174) for the input of postage items, and said carrier (160) is adjusted by said pre-adjusted device (160,164, 168).

23. A postage meter as defined in claim 22, wherein:

said transport device (174) has a guide wheel movable against spring pressure which upon deflection about a pre-given path actuates a switch (180), which creates said signal.

24. A postage meter as defined in claim 20, wherein:

said pre-adjusting device includes a spindle drive (164).

* * * * *